United States Patent [19]

Ohara et al.

[11] Patent Number: 5,020,440

[45] Date of Patent: Jun. 4, 1991

[54] CONVEYOR WITH PIVOTALLY DAMPED WORKPIECE CARRIER

[75] Inventors: Osamu Ohara; Hiroshi Kawashima; Hiroshi Takata, all of Shizuoka, Japan

[73] Assignee: Yamaha Hatsudoki Kabushiki Kaisha, Shizuoka, Japan

[21] Appl. No.: 470,929

[22] Filed: Jan. 25, 1990

[30] Foreign Application Priority Data

Jan. 31, 1989 [JP] Japan ..... 1-21149

[51] Int. Cl.[5] ..... B61B 3/00

[52] U.S. Cl. ..... 104/127; 104/91; 104/296; 212/213; 212/221

[58] Field of Search ..... 104/88, 89, 91, 93, 104/127, 295, 296; 105/27, 150; 414/591; 212/205, 213, 221; 198/678, 680

[56] References Cited

U.S. PATENT DOCUMENTS

| | | | |
|---|---|---|---|
| 902,839 | 11/1908 | Seaton | 212/221 |
| 1,047,699 | 12/1912 | Preacher | 105/150 |
| 1,148,482 | 7/1915 | Williamson | 104/93 |
| 2,061,857 | 11/1936 | Spurrier | 104/93 |
| 3,168,874 | 2/1965 | Atanasoff | 104/89 |
| 4,079,844 | 3/1978 | Whitaker et al. | 414/591 |
| 4,531,647 | 7/1985 | Higuchi et al. | 212/205 |
| 4,750,132 | 6/1988 | Pessina et al. | 212/205 |

*Primary Examiner*—Robert J. Oberleitner
*Assistant Examiner*—S. Joseph Morano
*Attorney, Agent, or Firm*—Ernest A. Beutler

[57] ABSTRACT

A conveying apparatus for conveying work pieces along a path defined by a track that can have ascending and descending sections. An elevator mechanism is pivotally supported relative to a drive mechanism that cooperates with the track for moving work pieces from one place to another. The pivotal support of the elevator mechanism permits the articles being transported to be maintained in a horizontal position regardless of whether or not the device is ascending or descending. In addition, a shock absorbing mechanism acts upon the pivotal connection so as to avoid swinging movement caused by starting and stopping.

8 Claims, 3 Drawing Sheets

CONVEYOR WITH PIVOTALLY DAMPED WORKPIECE CARRIER

BACKGROUND OF THE INVENTION

This invention relates to a freight system and more particularly to an improved device for carrying articles between different locations and at different elevations.

A wide variety of conveyor mechanisms have been proposed for moving articles or work pieces between stations along a factory area. One form of conveyor mechanism includes a guide rail that describes the path along which the articles will be moved and a conveyor mechanism which cooperates with this guide rail for moving the articles from place to place. Quite frequently it is desirable that the elevations where the articles are moved and delivered may be at different locations. In order to accommodate this, the guide rail must have ascending and descending sections. Also, the conveyor mechanism should include an elevator or lift arrangement wherein the articles can be raised and lowered so that the work stations can be spaced at different heights from the guide rail. Conveyor systems of this general type are shown in the copending applications entitled "Freight System", Ser. No. 385,576 filed July 26, 1989 and Ser. No. 391,476, filed Aug. 9, 1989 and assigned to the assignee hereof.

In many instances, it is desirable that the article being transported is maintained in a horizontal position even though the conveyor mechanism is ascending or descending. This can be accomplished by having a differential type of elevator mechanism that operates so as to maintain the article in its horizontal position. However, such systems are quite complicated and further add to the complexity of the necessary controls.

It is, therefore, a principal object of this invention to provide an improved conveying apparatus for moving articles along a path at different levels and maintaining the article in a horizontal position even when ascending or descending.

It is a further object of this invention to provide a relatively simple conveyor mechanism wherein articles may be raised and lowered while they travel along a path and will be automatically and simply maintained in a horizontal position during such movement.

SUMMARY OF THE INVENTION

This invention is adapted to be embodied in a conveying apparatus for conveying articles along a path between different levels while maintaining the article in a horizontal position regardless of the angle of inclination of the path. The apparatus comprises a drive member for conveying the apparatus along the path. An elevator mechanism is supported for pivotal movement relative to the drive member about an axis that extends transversely to the direction of movement. A gripping mechanism is carried by the elevator mechanism for gripping an article and the elevator mechanism is operative to vary the distance between the gripper and the drive member.

DETAILED DESCRIPTION OF THE PREFERRED EMBODIMENT OF THE INVENTION

Figure 1:
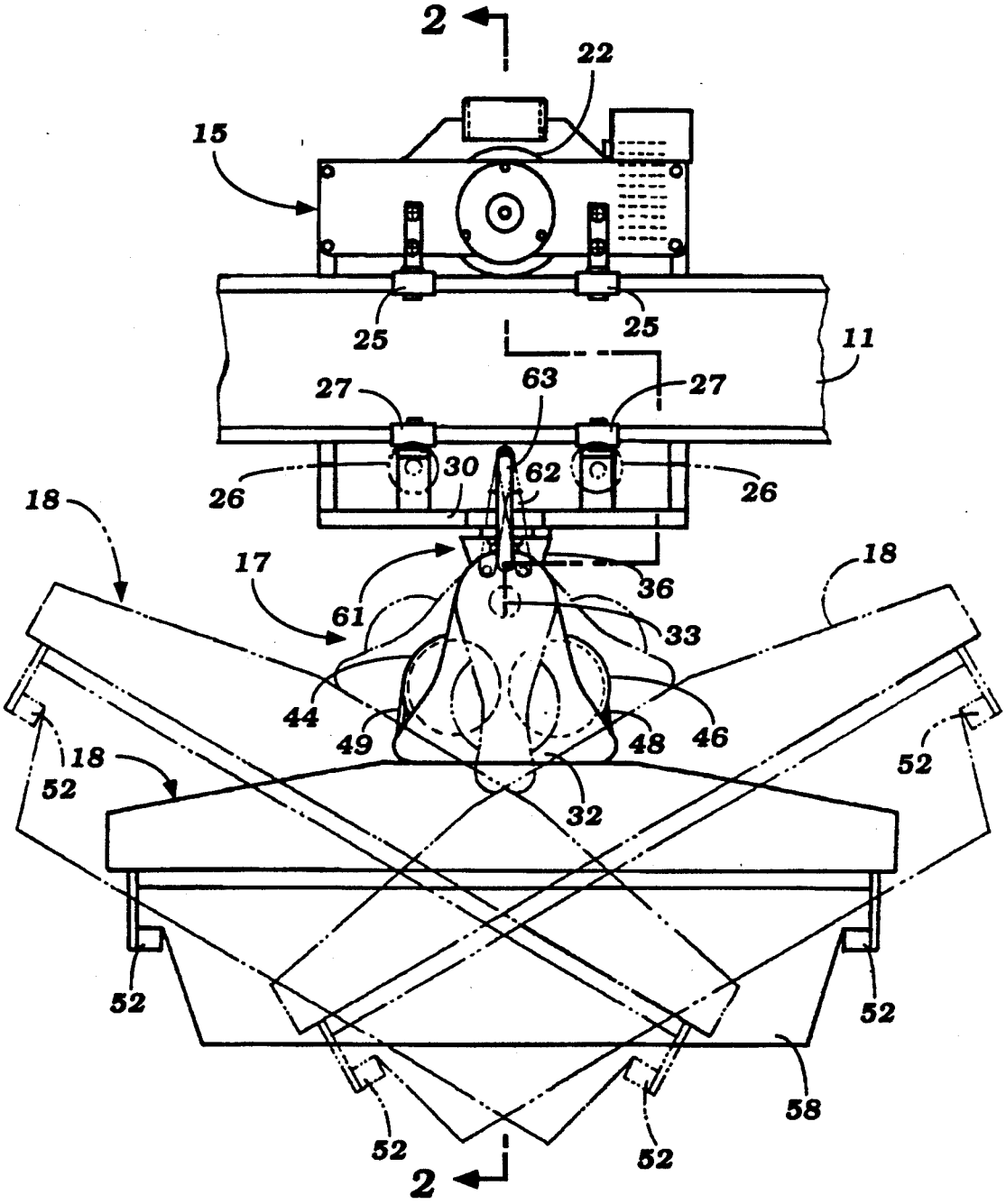
FIG. 1 is a side elevational view of the conveyor apparatus constructed in accordance with an embodiment of the invention and shows the various orientations which the transported article may assume relative to the guide rail as the device ascends or descends.
Figure 2:
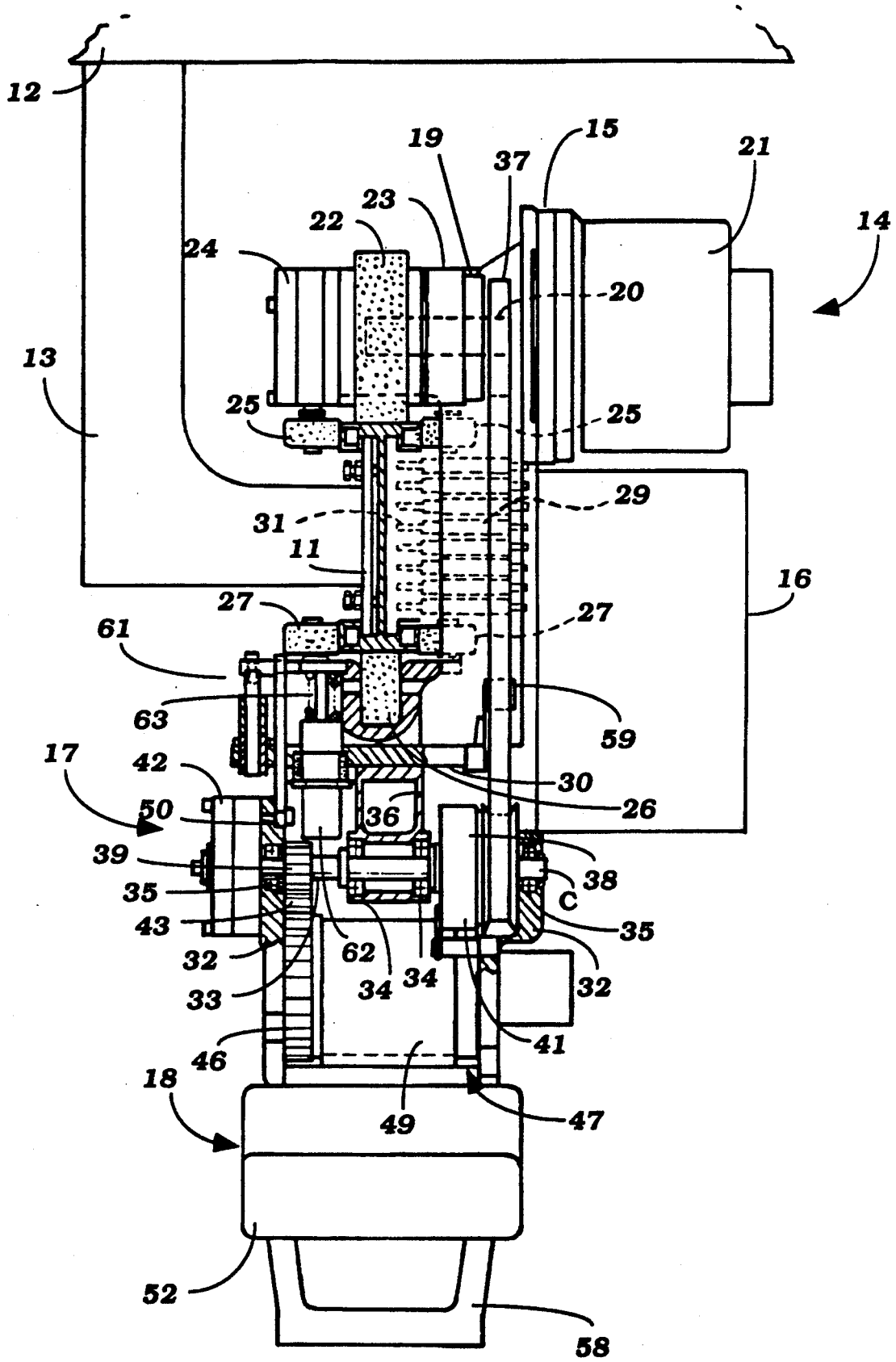
FIG. 2 is a cross sectional view taken along the line 2—2 of FIG. 1.

In the drawings, the reference numeral 11 indicates generally a guide rail that defines a path along which articles may be transmitted by the conveyor mechanism to be described. The guide rail 11 has a generally I beam shaped configuration and is supported from the roof 12 of a factory by means of a plurality of L shaped brackets 13. The conveying mechanism for moving the articles along the guide rail 11 is indicated generally by the reference numeral 14 and is comprised of a drive or conveying assembly 15, a control box 16, an elevator or lift mechanism, indicated generally by the reference numeral 17 and a gripping mechanism, indicated generally by the reference numeral 18. Except as hereinafter noted, the conveyor construction may be of the type generally disclosed in the aforenoted copending application Ser. No. 385,576 and 391,476. For that reason, the layout of the associated factory in which the conveying mechanism is used is not illustrated. It is to be understood, however, that the guide rail 11 is configured so as to travel up and down inclines so that various work levels in the associated factory can be accommodated.

The drive mechanism 15 includes a generally C shaped frame assembly 19 that mounts a high torque, low speed D.C. electrical drive motor 21 at the upper end thereof and at one side of the guide rail 11. The motor 21 drives an output shaft 20 which, in turn, drives a frictional drive wheel 22 through a selectively operable clutch assembly 23. The clutch assembly 23 may be of the electrically operated type. In addition, an electrically operated brake 24 also acts upon the drive wheel 22 for braking its rotation and holding the drive mechanism 15 in a fixed position relative to the guide rail 11. The drive wheel 22 engages the upper side of the upper flange of the I beam 11. In addition, pairs of transverse guide rollers 25 engage opposite sides of this upper flange so as to provide stability and so as to permit the device to follow curves as well as up and down movement.

Figure 3:
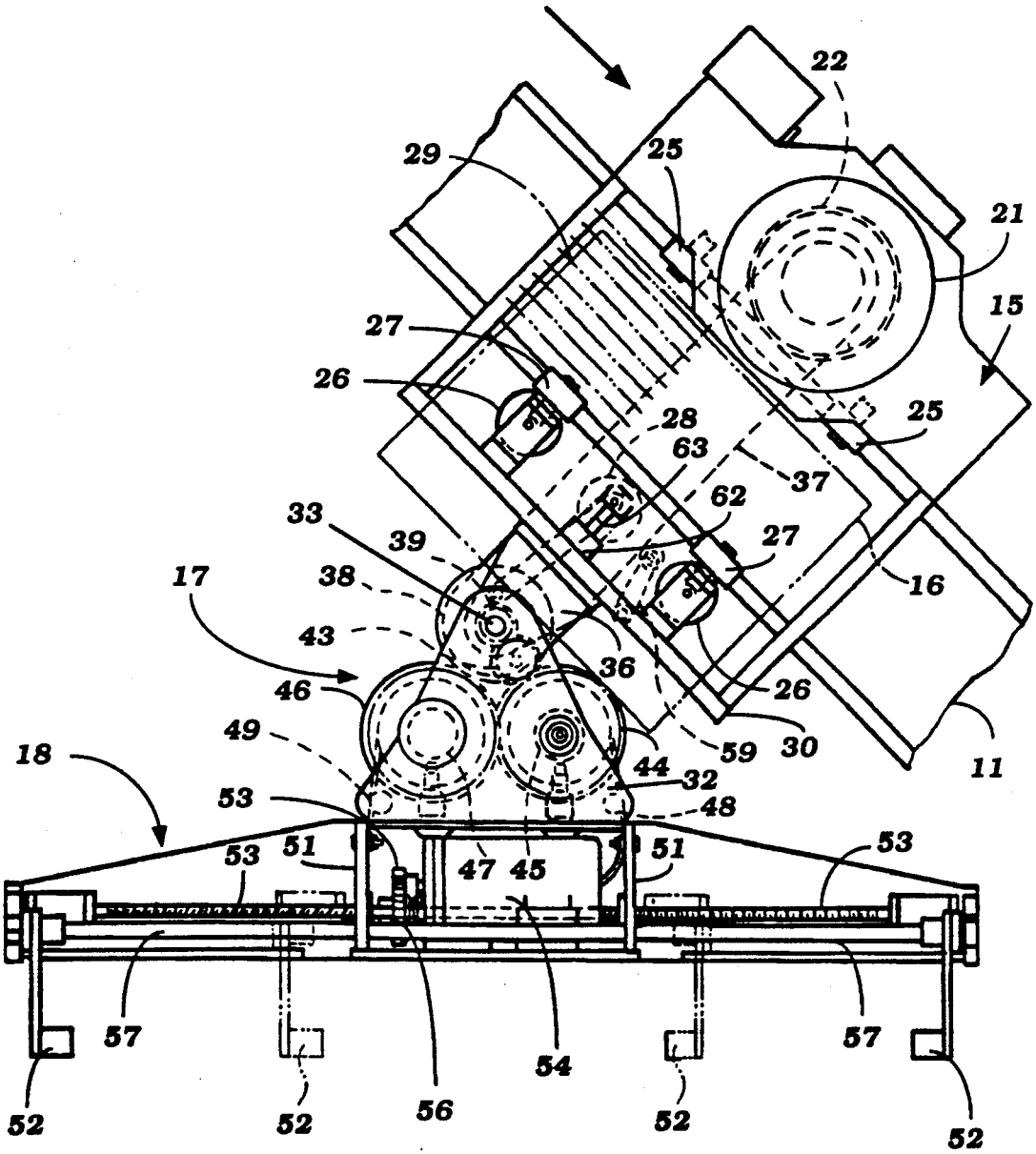
FIG. 3 is a side elevational view, in part similar to FIG. 1, and shows the arrangement when travelling up an incline and how the gripped article can be maintained in a horizontal position.

The lower end of the frame assembly 19 includes a plate 30 which carries a pair of spaced apart wheels 26 that engage the underside of the lower flange of the I beam track 11 and hold the drive wheel 22 in engagement with the upper flange thereof. In addition, pairs of side guide rollers 27 engage the opposite sides of this flange so as to maintain the device in alignment and so as to permit it to round curves as well as go up and down through cooperation with the upper pairs of wheels 25. Rather than using a pair of wheels 26 in engagement with the underside of the guide rail 11, there may be provided only a single, centrally positioned pressure roller as shown in phantom in FIG. 3 and identified by the reference numeral 28.

The electrical power for operating the motor 21 and control 16 and the various other components which have been and will be described is transmitted to the conveyor assembly 14 by means of a pantograph 29 that receives power and signals from a trolley line 31 carried on one side of the guide rail 11.

The elevator or lift mechanism 17 includes a lower frame assembly that is comprised of a pair of generally triangular shaped spaced apart support plates 32 which are suspended from a member 36 of the frame assembly 19 by means of a shaft 33. The shaft 33 is journaled relative to the member 36 of the frame assembly 19 by means of a pair of spaced apart bearings 34 and, in turn, journals the support plates 32 by means of spaced apart bearings 35. As a result of this suspension arrangement, the elevator mechanism 17 may pivot relative to the drive mechanism 15 as clearly shown in FIGS. 1 and 3 about the pivot axis defined by the shaft 33.

In addition to providing for the pivotal support of the lift mechanism 17 relative to the drive mechanism 15, the shaft 33 also serves as a drive shaft for this lift mechanism 17. To this end, affixed to the drive shaft 20 of the motor 21 is a further pulley which drives a belt 37 which, in turn, drives a pulley 38. The shaft 33 selectively drives a gear 39 through a selectively operable electrically actuated clutch 41 which is driven by the pulley 38. In addition, a selectively operable electrical brake 42 operates on the shaft 33 for braking its rotation when the clutch 41 is disengaged.

The gear 39 driven when the clutch 41 is engaged is enmeshed with an intermediate gear 43 which, in turn, drives a gear 44 that is affixed to an elevator drum 45. In addition, the gear 44 meshes with a further gear 46 which drives a further elevator drum 47. Cables or belts 48 and 49 are wound on the drums 44 and 46 respectively and are connected to a lower frame assembly 51 of the gripping mechanism 18.

The gripping mechanism 18 includes a pair of gripping members 52 that have threaded connections to a pair of screw shafts 53 which have end portions of opposite hand and which are journaled on the frame assembly 51. A drive motor 54 drives the screw shafts 53 through a gear train comprised of a gear 55 on the output shaft of the motor 54 and a pair of intermeshing gears 56 that are affixed to the screw shafts 53. The gripping members 52 are further supported on support rods 57 that are connected to the frame assembly 51 so that as the motor 54 rotates in selected directions, the gripping members 52 will move toward or away from each other between the solid and dotted line positions shown in FIG. 3 so as to selectively pick up an article or work piece 58 and deposit it at varying stations. The drive belt 37 is normally tensioned by means of a tensioner assembly, indicated generally by the reference numeral 59 and which is supported on the frame member 33 of the frame 19.

Although the use of the pivotal support shaft 33 permits the gripping mechanism 18 and articles suspended by it to pivot relative to the drive mechanism 15 when grades are ascended and descended, it is important to insure that the pivotal movement will not permit swinging movement due to starting and stopping of the drive mechanism 15. To avoid such action, there is provided a shock absorber assembly, indicated generally by the reference numeral 61 which may be of any suitable type.

In the illustrated embodiment, this shock absorber mechanism 61 includes a conventional hydraulic piston type damper 62 that has a piston rod 63. The shock absorber mechanism 62 is affixed to the frame member 30 in a suitable manner. The piston rod 63 is actuated upon swinging movement by a link mechanism so as to dampen this pivotal movement.

The system can operate in a wide variety of manners, but basically when it is in a stopped position, the clutch 23 is disengaged and the brake 24 is engaged so that the drive mechanism 15 will be held in position on the conveyor rail 11. At this time, the clutch 41 will also be disengaged. The brake 42 will be engaged so that the elevator mechanism is not operative. However, if it is desired to raise or lower the work pieces 58, the clutch 41 is engaged, the brake 42 is released and the elevator mechanism can be raised and lowered. Also, the electric motor 54 may be energized in one direction or another to open or close the grippers 52 to grip or release the articles 58.

When it is desired to move an article 58 carried by the gripper mechanism 52, the clutch 23 is engaged and the brake 24 is released so that the drive wheel 22 will be driven and drive the conveyor mechanism along the guide rail 11. As may be seen from FIGS. 1 and 3, when the device is ascending or descending, the gripping mechanism 18 can pivot about the pivot shaft and drive shaft 33 so that the work pieces 58 will always be held in a horizontal orientation. The shock absorber mechanism 62 will yield under these conditions so as to permit this result to be achieved without permitting swinging due to starting and stopping operation.

In the illustrated embodiment, the shaft 33 functions both as a pivot shaft and a drive shaft for the elevator mechanism. It is to be understood, of course, that the elevator mechanism may be driven from a separate driven shaft than the pivot shaft and, in fact, a separate drive motor may be provided for the elevator mechanism. However, the device permits articles to be held in a horizontal position regardless of whether or not the device is ascending or descending and without necessitating the use of a differential elevator mechanism.

It is to be understood that the foregoing description is that of a preferred embodiment of the invention. Various changes and modifications may be made without departing from the spirit and scope of the invention, as defined by the appended claims.

We claim:

1. A conveying apparatus for conveying articles along a path between different levels while maintaining the article in a horizontal position regardless of the angle of inclination of the path, said apparatus comprising a drive member for conveying said apparatus along the path, a driving motor carried by said drive member and driving a shaft journaled thereon, an elevator mechanism supported by said shaft for pivotal movement relative to said drive member about an axis extending transversely to the direction of movement, and means carried by said elevator for handling an article, said elevator being operative to vary the height between the article and the drive member.

2. A conveying apparatus as set forth in claim 1 wherein a single driving motor drives both the drive member and the elevator mechanism.

3. A conveying apparatus as set forth in claim 1 wherein the shaft is driven from the driving motor by a flexible transmitter.

4. A conveying apparatus as set forth in claim 1 wherein the elevator mechanism comprises a pair of spaced apart drums and flexible transmitters wound therearound and supporting a gripping mechanism.

5. A conveying apparatus as set forth in claim 1 further including shock absorbing means for preventing pivotal movement of the elevator mechanism about the axis in response to abrupt starts and stops.

6. A conveying apparatus as set forth in claim 4 wherein a single driving motor drives both the drive member and the elevator mechanism.

7. A conveying apparatus as set forth in claim 6 wherein the shaft is driven from the driving motor by a flexible transmitter.

8. A conveying apparatus as set forth in claim 7 further including shock absorbing means for preventing pivotal movement of the elevator mechanism about the axis in response to abrupt starts and stops.

* * * * *